US006467861B1

(12) United States Patent
Thielman et al.

(10) Patent No.: US 6,467,861 B1
(45) Date of Patent: Oct. 22, 2002

(54) LEAK DETECTION FOR AN INK CONTAINER

(75) Inventors: Jeffrey L. Thielman, Corvallis, OR (US); Rhonda L. Wilson, Monmouth, OR (US); Paul Mark Haines, Lebanon, OR (US); Mark A. DeVries, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/574,691

(22) Filed: May 17, 2000

Related U.S. Application Data

(63) Continuation-in-part of application No. 09/145,199, filed on Sep. 1, 1998.

(51) Int. Cl.[7] ..... B41J 29/38
(52) U.S. Cl. ..... 347/6; 347/84; 347/85
(58) Field of Search ..... 347/6, 7, 84, 85, 347/89, 19; 73/37, 37.8, 40, 40.5

(56) References Cited

U.S. PATENT DOCUMENTS 4,542,390 A * 9/1985 Bruning et al. ..... 347/35
4,639,738 A * 1/1987 Young et al. ..... 347/89
4,684,345 A * 8/1987 Cattani ..... 433/92
4,837,585 A * 6/1989 Williams et al. ..... 347/89
5,363,130 A 11/1994 Cowger et al. ..... 347/92
5,418,557 A * 5/1995 Pullen ..... 347/84
5,426,459 A 6/1995 Kaplinsky ..... 347/87
5,583,547 A 12/1996 Gast et al. ..... 347/22
5,600,358 A 2/1997 Baldwin et al. ..... 347/87
5,900,896 A * 5/1999 Barinaga et al. ..... 347/86
5,956,062 A * 9/1999 Omata et al. ..... 347/89

* cited by examiner

*Primary Examiner*—Hai Pham
*Assistant Examiner*—Julian D. Huffman

(57) ABSTRACT

An inkjet printing system includes an ink container adapted to hold a supply of liquid ink therein and a printhead communicating with the supply of liquid ink via a flow path. A pressure sensor measures a pressure of liquid ink disposed in the flow path and a volume detector detects a volume of liquid ink delivered through the flow path. In addition, a leak indicator communicates with the pressure sensor and the volume detector, and indicates an ink container leak based on the pressure of liquid ink disposed in the flow path and the volume of liquid ink delivered through the flow path.

22 Claims, 4 Drawing Sheets

LEAK DETECTION FOR AN INK CONTAINER

CROSS-REFERENCE TO RELATED APPLICATIONS

This application is a Continuation-in-Part of U.S. application Ser. No. 09/145,199, filed Sep. 01, 1998, which is incorporated herein by reference.

THE FIELD OF THE INVENTION

The present invention relates generally to inkjet printing systems, and more particularly to detection of an ink container leak in an inkjet printing system.

BACKGROUND OF THE INVENTION

A conventional inkjet printing system includes a printhead and an ink supply which supplies liquid ink to the printhead. The printhead ejects ink drops through a plurality of orifices or nozzles and toward a print medium, such as a sheet of paper, so as to print a dot of ink on the print medium. Typically, the orifices are arranged in one or more arrays such that properly sequenced ejection of ink from the orifices causes characters or other images to be printed upon the print medium as the printhead and the print medium are moved relative to each other. In one arrangement, commonly referred to as "on-axis" printing, the ink supply is an integral element with the printhead. In another arrangement, however, commonly referred to as "off-axis" printing, the ink supply is a separate, self-contained ink container connected with the printhead by, for example, a flexible tube. With an off-axis printing system, the mass of the printhead is sharply reduced such that the cost of a printhead drive system and an overall size of a printer can be minimized, and a speed of printing can be increased. In addition, separating the ink supply from the printhead allows the ink to be replaced as it is consumed without requiring replacement of the costly printhead.

A conventional self-contained ink container for an off-axis printing system typically includes a housing and a collapsible ink reservoir, in the form of a bladder or bag, disposed within the housing for holding a supply of liquid ink therein. As such, a pressurized air system releases pressurized air into the housing and around the ink reservoir to collapse the ink reservoir and deliver ink to the printhead. The potential exists, however, for the collapsible ink reservoir to develop a leak. The leak could result, for example, from a pin hole in the collapsible ink reservoir, a rupture of the collapsible ink reservoir, and/or a defective seal of the collapsible ink reservoir. Unfortunately, if a leak does develop, air from the pressurized air system could enter the collapsible ink reservoir. As such, air in the collapsible ink reservoir could be drawn into the printhead thereby causing damage to the printhead. Furthermore, if a leak does develop, ink can escape from the collapsible ink reservoir. If the ink container is installed with the printing system, ink escaping from the collapsible ink reservoir can enter and contaminate the pressurized air system. If the ink container is separate from the printing system, ink escaping from the collapsible ink reservoir can spill from the housing.

Accordingly, a need exists for detection of a leak of a collapsible ink reservoir of an ink container such that the potential for drawing air into a printhead through the collapsible ink reservoir is avoided and/or complications caused by ink escaping from the collapsible ink reservoir are avoided.

SUMMARY OF THE INVENTION

One aspect of the present invention provides a printing system including a printhead, an ink container communicating with and supplying liquid ink to the printhead, and a leak indicator communicating with and indicating an ink container leak based on a pressure of liquid ink supplied to the printhead and a volume of liquid ink supplied to the printhead.

In one embodiment, the leak indicator indicates the ink container leak when the pressure of liquid ink supplied to the printhead is less than a predetermined value and the volume of liquid ink supplied to the printhead is greater than a predetermined value. In one embodiment, the volume of liquid ink supplied to the printhead is derived from a count of a number of drops of the liquid ink ejected from the printhead.

In one embodiment, a pressurized source of gas communicates with and supplies pressurized gas to the ink container so as to pressurize the ink container and expel liquid ink from the ink container during printing. As such, the pressure of liquid ink supplied to the printhead is based on a differential pressure of liquid ink supplied to the printhead and pressurized gas supplied to the ink container.

Another aspect of the present invention provides a printing system including an ink container adapted to hold a supply of liquid ink therein, a first flow path communicating with the ink container and the supply of liquid ink, and a printhead communicating with the first flow path. A pressure sensor communicates with the first flow path and measures a pressure of liquid ink disposed therein, and a volume detector communicates with the first flow path and detects a volume of liquid ink delivered therethrough. A leak indicator communicates with the pressure sensor and the volume detector, and indicates an ink container leak based on the pressure of liquid ink disposed in the first flow path and the volume of liquid ink delivered through the first flow path.

Another aspect of the present invention provides a method of detecting an ink container leak of an ink container adapted to hold a supply of liquid ink therein. The method includes the steps of pressurizing the ink container to expel liquid ink therefrom, measuring a pressure of liquid ink expelled from the ink container, measuring a volume of liquid ink expelled from the ink container, and indicating the ink container leak based on the pressure of liquid ink expelled from the ink container and the volume of liquid ink expelled from the ink container.

Another aspect of the present invention provides a printing system including a housing having walls defining an interior chamber adapted to hold a supply of liquid ink therein such that the supply of liquid ink defines an occupied portion and an unoccupied portion of the interior chamber. A first flow path communicates with the occupied portion of the interior chamber of the housing and externally of the housing, and a second flow path communicates with the unoccupied portion of the interior chamber of the housing and externally of the housing. As such, the first flow path is adapted to deliver liquid ink therethrough and the second flow path is adapted to receive pressurized gas therethrough. In addition, a pressure sensor communicates with and is adapted to measure a pressure of liquid ink delivered through the first flow path.

Another aspect of the present invention provides a printing system including a housing defining an interior chamber and a collapsible reservoir disposed within the interior chamber, wherein the collapsible reservoir is adapted to hold a supply of liquid ink therein. A first flow path communicates with the collapsible reservoir and externally of the housing, and a second flow path communicates with the interior chamber of the housing and externally of the housing. As such, the first flow path is adapted to deliver liquid ink therethrough and the second flow path is adapted to receive pressurized gas therethrough. In addition, a pressure sensor communicates with and is adapted to measure a pressure of liquid ink delivered through the first flow path.

The present invention provides a printing system which includes detection of an ink container leak in the printing system and, more specifically, detection of a leak in a collapsible ink reservoir of an ink container in the printing system. As such, the potential for drawing air into a printhead of the printing system through the ink container leak is avoided and/or complications caused by ink escaping from the collapsible ink reservoir are avoided.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
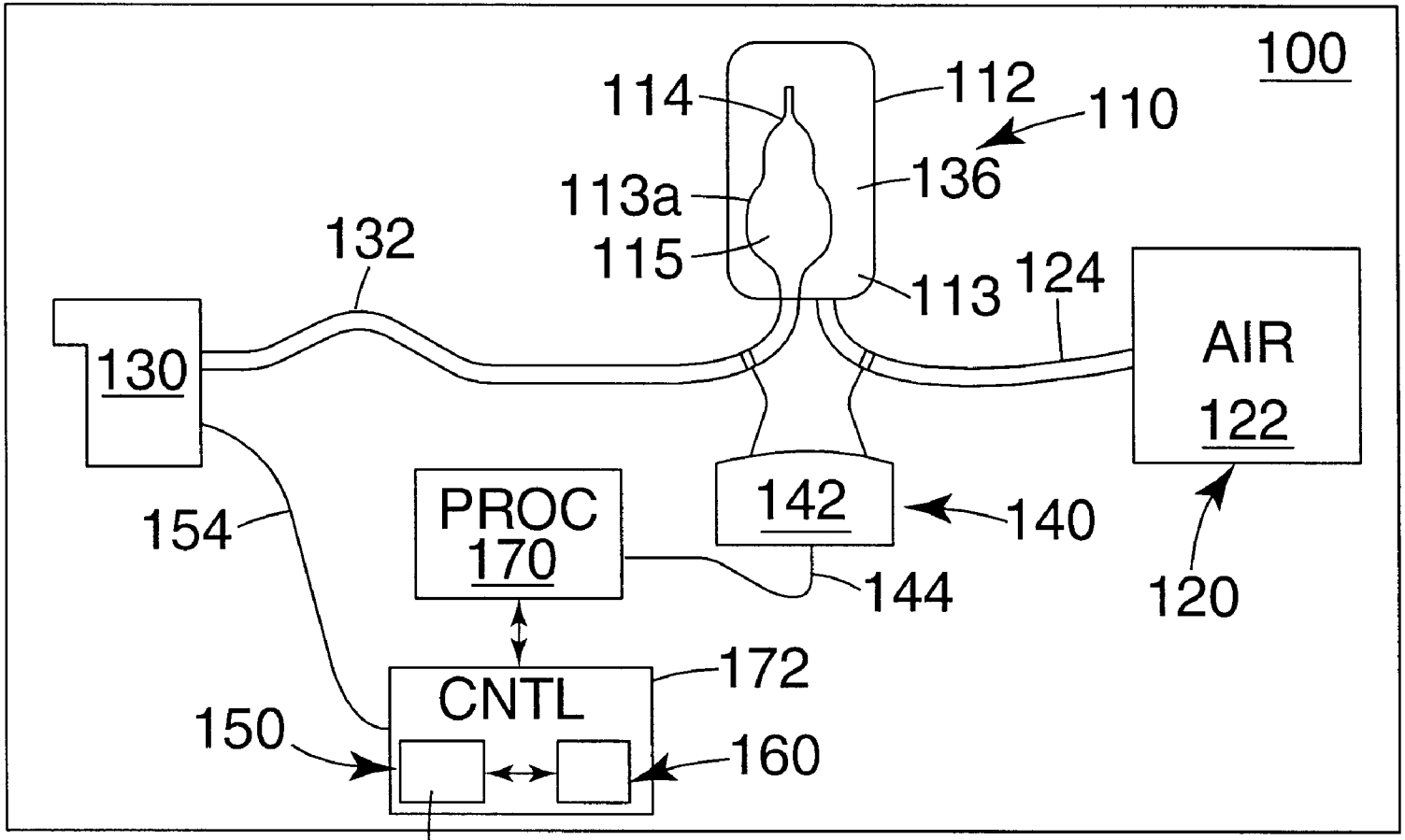
FIG. 1 is a schematic illustration of a portion of one embodiment of an inkjet printing system according to the present invention.

FIG. 1 illustrates one embodiment of a portion of an inkjet printing system 100 according to the present invention. Inkjet printing system 100 includes an ink container 110, a pressurized source 120, a printhead 130, a pressure sensor 140, a volume detector 150, and a leak indicator 160. Ink container 110 is adapted to hold a supply of liquid ink therein. Pressurized source 120 and printhead 130 each communicate with ink container 110 such that pressurized source 120 pressurizes ink container 110 to deliver liquid ink to printhead 130 during printing. Pressure sensor 140 and volume detector 150 measure a pressure and a volume, respectively, of liquid ink delivered from ink container 110. Leak indicator 160 indicates a leak of ink container 110 based on the pressure and the volume, as measured by pressure sensor 140 and volume detector 150, respectively, of liquid ink delivered from ink container 110. While pressure sensor 140, volume detector 150, and leak indicator 160 are illustrated schematically as being formed separately from ink container 110, it is within the scope of the present invention for pressure sensor 140, volume detector 150, and/or leak indicator 160 to be formed integrally with ink container 110.

In one embodiment, ink container 110 includes a housing 112 and a collapsible ink reservoir 114. Housing 112 defines an interior chamber 113 in which collapsible ink reservoir 114 is disposed such that collapsible ink reservoir 114 defines an occupied portion 113*a* of interior chamber 113. Thus, an unoccupied portion 113*b* of interior chamber 113 is formed between housing 112 and collapsible ink reservoir 114. In one embodiment, collapsible ink reservoir 114 is formed by a flaccid bag 115. When full of liquid ink, flaccid bag 115 substantially occupies interior chamber 113 of housing 112. While housing 112 is illustrated as being substantially rectangular in shape, it is within the scope of the present invention for housing 112 to be of any size, shape, and/or volume.

Pressurized source 120 includes a pressurized source of gas. In one embodiment, the gas is air delivered by a pump 122. As such, pump 122 generates and delivers pressurized air to ink container 110 via a pressure supply line 124. Thus, pressurized air pressurizes ink container 110 so as to expel liquid ink therefrom. While the following description only refers to using pressurized air, it is understood that use of other gases, or combinations of gases, is within the scope of the present invention.

Printhead 130 has a plurality of ink orifices (not shown) formed therein in a manner well known to those skilled in the art. Example embodiments of printhead 130 include a thermal printhead, a piezoelectric printhead, a flex-tensional printhead, or any other type of inkjet ejection device known in the art. If printhead 130 is, for example, a thermal printhead, printhead 130 typically includes a substrate layer (not shown) having a plurality of resistors (not shown) which are operatively associated with the ink orifices. Upon energization of the resistors, in response to command signals to printhead 130, drops of liquid ink are ejected through the ink orifices toward a print medium (not shown). In one embodiment, printhead 130 receives liquid ink from ink container 110 via an ink supply line 132.

In one embodiment, pressure sensor 140 includes a differential pressure sensor 142. Thus, differential pressure sensor 142 communicates with both pressure supply line 124 and ink supply line 132. As such, differential pressure sensor 142 measures a pressure differential between a pressure of air disposed within pressure supply line 124 and a pressure of liquid ink disposed within ink supply line 132. An example of differential pressure sensor 142 includes a wet-wet differential pressure sensor manufactured by Omega Engineering.

Since pressurized air delivered through pressure supply line 124 causes ink to be expelled from ink container 110, the pressure of air disposed within pressure supply line 124 is proportional to the pressure of liquid ink disposed within ink supply line 132. Thus, increases and decreases in air pressure result in similar increases and decreases in ink pressure. Use of differential pressure sensor 142 compensates for ink pressure changes that are caused by air pressure fluctuations and also permits use of a non-constant air supply pressure. It should be recognized that the amount of pressure exerted by the ink is also, to some extent, dependent on the height of ink container 110 above pressure sensor 140. Thus, as the height of ink container 110 over pressure sensor 140 increases, the weight or pressure of the ink at pressure sensor 140 also increases.

In one embodiment, volume detector 150 includes a drop counter 152. Thus, drop counter 152 communicates with printhead 130 to count a number of drops of liquid ink ejected from printhead 130 during printing as described, for example, in U.S. Pat. No. 5,583,547, which is incorporated herein by reference. More specifically, drop counter 152 counts a number of fire signals propagated to printhead 130. As such, multiplication of this count by an average volume of the ink drops provides an approximation of a volume of liquid ink expelled from printhead 130 and, therefore, ink container 110. Thus, subtraction of the volume of liquid ink expelled from printhead 130 from an initial volume of liquid ink contained within ink container 110 provides an approximation of a volume of liquid ink remaining within ink container 110.

As illustrated in FIG. 1, leak indicator 160 communicates with pressure sensor 140 and volume detector 150. In one embodiment, volume detector 150 communicates with printhead 130 via a signal line 154 and leak indicator 160 communicates with pressure sensor 140 via a processing circuit 170. In the embodiment illustrated in FIG. 1, volume detector 150 and leak indicator 160 are incorporated in a control circuit 172 which is coupled to processing circuit 170. As such, pressure sensor 140 communicates a pressure signal to processing circuit 170 via a signal line 144.

Processing circuit 170 includes signal processing circuitry which processes the pressure signal on signal line 144 to provide a suitable digital representation of the pressure signal to control circuit 172. Example circuitry provided in processing circuit 170 includes an on-board calibration EPROM which compensates for sensor drift, an amplifier which amplifies the pressure signal, a filter which filters the pressure signal, and an analog-to-digital converter which converters the pressure signal from analog to digital form. While processing circuit 170 is illustrated schematically as being formed separately from pressure sensor 140, it is within the scope of the present invention for processing circuit 170 to be formed integrally with pressure sensor 140. More specifically, the amplifier, the filter, and/or the analog-to-digital converter can be formed separately from or integrally with pressure sensor 140.

Control circuit 172 includes firmware and control logic for processing output signals corresponding to the pressure differential and the approximate volume of expelled ink and for determining a leak of the collapsible ink reservoir 114 based on such signals. As such, control circuit 172 provides control for volume detector 150, leak indicator 160, and processing circuit 170.

In use, ink container 110 communicates with pressurized source 120 and printhead 130 via pressure supply line 124 and ink supply line 132, respectively, as illustrated in FIG. 1. As such, pressurized air is released into interior chamber 113 to pressurize and collapse collapsible ink reservoir 114. Thus, liquid ink is forced through ink supply line 132 to printhead 130 during printing. In addition, differential pressure sensor 142 measures the differential pressure between pressure supply line 124 and ink supply line 132, and drop counter 152 counts the number of drops of liquid ink ejected from printhead 130. While ink drop counting can occur during printing, pressure readings are taken during printing pauses because dynamic pressure losses that occur during printing could reduce the accuracy of a comparison of a measured pressure with a predetermined pressure, as relied upon below.

Figure 2:
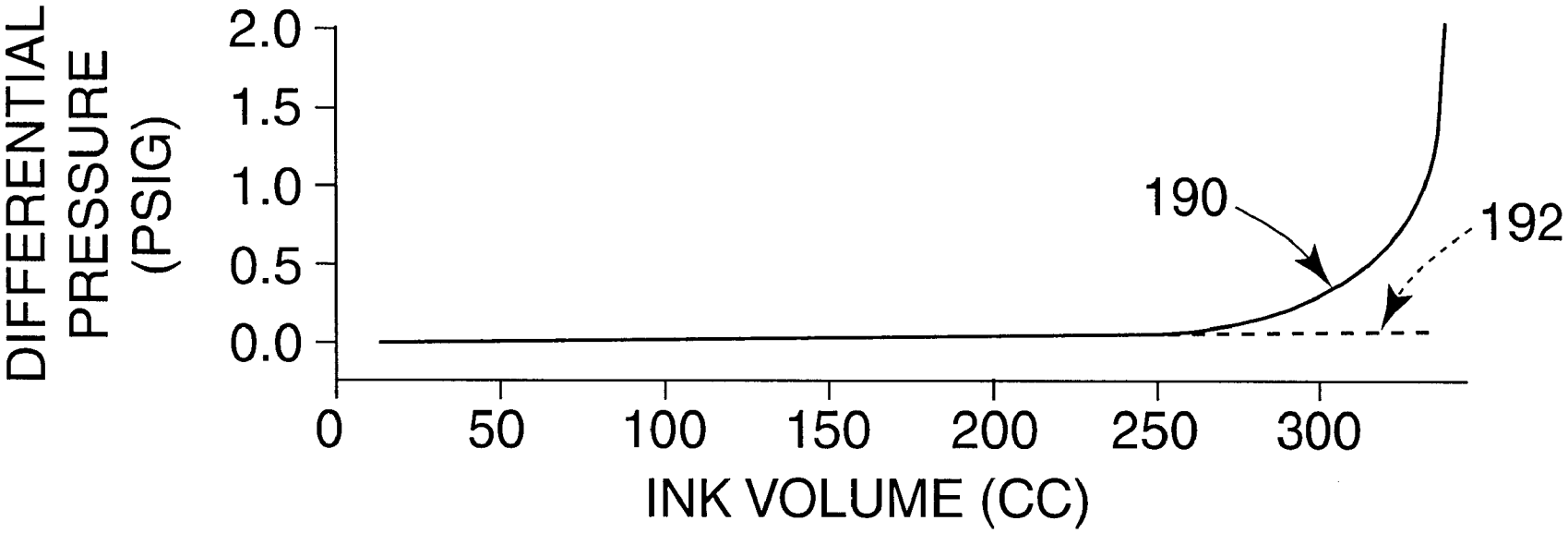
FIG. 2 is graphical representation of differential pressure and consumed ink volume of an inkjet printing system according to the present invention.

FIG. 2 illustrates a graphical representation of differential pressure versus consumed ink volume for a 350 cc ink supply. For a substantial part of the ink supply life, the pressure in ink supply line 132 is approximately equal to the pressure in pressure supply line 124 (gravity being compensated for). Thus, the differential pressure is approximately zero. Typically, as the volume of liquid ink consumed exceeds a predetermined value, for example, 250 cc for the 350 cc ink supply, the pressure in ink supply line 132 begins to decrease thereby yielding an increase in the differential pressure, as illustrated by line 190 in FIG. 2. Stated conversely, a decrease in pressure within ink supply line 132 is indicative of a reduction of the volume of liquid ink contained within collapsible ink reservoir 114. Thus, a relationship between ink volume and ink pressure is sufficiently predictable to establish an accurate approximation of the volume of liquid ink consumed based on a measured pressure.

If collapsible ink reservoir 114 develops a leak, however, pressurized air will enter collapsible ink reservoir 114. As such, pressure in ink supply line 132 will approximate pressure in pressure supply line 124. Thus, the differential pressure measured by differential pressure sensor 142 will remain approximately zero as the volume of liquid ink consumed exceeds the predetermined value, for example, 250 cc for the 350 cc ink supply, as illustrated by line 192 in FIG. 2.

Unfortunately, as the volume of liquid ink within collapsible ink reservoir 114 is depleted, the potential exists for air to be delivered to printhead 130 thereby potentially causing damage to printhead 130. Therefore, if the volume of liquid ink delivered through ink supply line 132, as measured by volume detector 150, is greater than a predetermined value, for example, 250 cc for the 350 cc ink supply, and the pressure of liquid ink disposed within ink supply line 132, as measured by pressure sensor 140, is less than a predetermined value, for example, 0.1 psig for the 350 cc ink supply, leak indicator 160 indicates a leak of ink container 110.

To avoid damaging printhead 130, leak indicator 160, via control circuit 172, discontinues operation of printhead 130 when the ink container leak is indicated. As such, delivery of ink from ink container 110 to printhead 130 is discontinued. In one embodiment, leak indicator 160 informs a user of printing system 100 of the ink container leak with, for example, a visual and/or audible cue. In addition, control circuit 172 stores indication of the ink container leak. It should be recognized that the predetermined values or actual thresholds at which the ink container leak is declared may be determined empirically and will vary depending on an initial volume of liquid ink contained within collapsible ink reservoir 114 and a design of collapsible ink reservoir 114 including, for example, shape, size, and/or material thereof.

Figure 3:
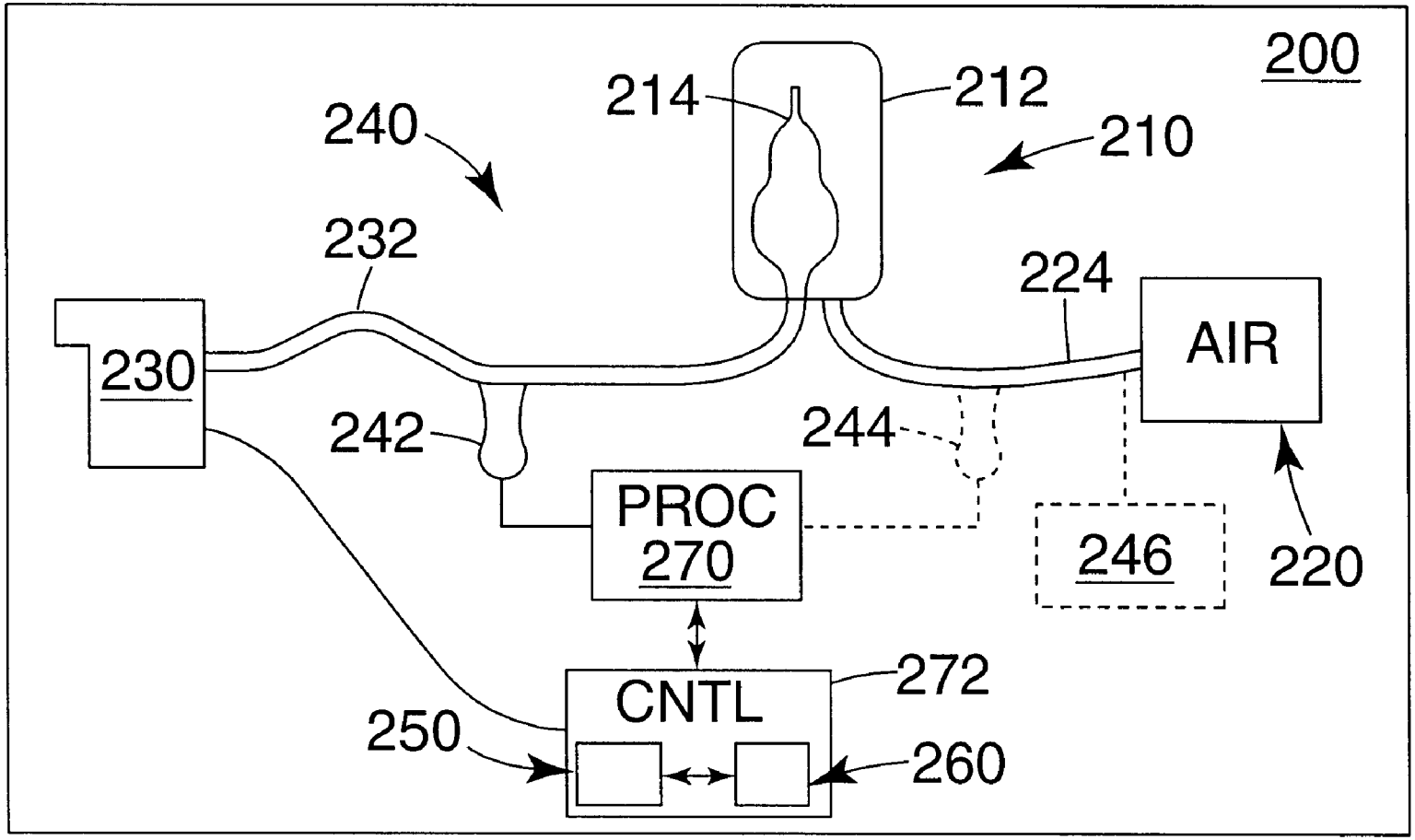
FIG. 3 is a schematic illustration of a portion of another embodiment of an inkjet printing system according to the present invention.

FIG. 3 illustrates another embodiment of a portion of an inkjet printing system 200 according to the present invention. Inkjet printing system 200 includes an ink container 210, a pressurized source 220, a printhead 230, a pressure sensor 240, a volume detector 250, and a leak indicator 260. Ink container 210 includes a housing 212 and a collapsible ink reservoir 214, and communicates with pressurized source 220 and printhead 230 via a pressure supply line 224 and an ink supply line 232, respectively. Further configuration and operation of ink container 210, pressurized source 220, printhead 230, volume detector 250, and leak indicator 260 are similar to that previously described in connection with inkjet printing system 100.

In one embodiment, pressure sensor 240 includes two absolute or gauge pressure sensors 242 and 244. Absolute pressure sensor 242 communicates with ink supply line 232 and absolute pressure sensor 244 communicates with pressure supply line 224. As such, a pressure difference signal representing a pressure difference between liquid ink in ink supply line 232 and air in pressure supply line 224 is generated in processing circuit 270 from output signals of absolute pressure sensors 242 and 244. The pressure difference signal is then processed by control circuit 272 in a manner similar to how differential pressure output signal of differential pressure sensor 142 is processed by control circuit 172.

In another embodiment, absolute pressure sensor 244 is replaced with a pressure regulator 246 that assures that pressure delivered to collapsible ink reservoir 214 remains constant. As such, output of absolute pressure sensor 242 is compared to a constant pressure reference signal. It is, however, also within the scope of the present invention for pressure switches to be utilized rather than pressure sensors. While pressure sensors measure a continual pressure change, pressure switches output an ON or OFF signal based on whether the measured pressure is above or below an established threshold.

By detecting a leak of ink containers 110 and 210, inkjet printing systems 100 and 200, respectively, avoid drawing air through the ink container leak and into collapsible ink reservoirs 114 and 214, respectively. Thus, the potential for drawing air into printheads 130 and 230, respectively, through collapsible ink reservoirs 114 and 214, respectively, is avoided. In addition, inkjet printing systems 100 and 200 avoid complications, such as contamination of pressurized sources 120 and 220, respectively, and spilled ink, which can result from ink leaking from collapsible ink reservoirs 114 and 214, respectively.

Figure 4:
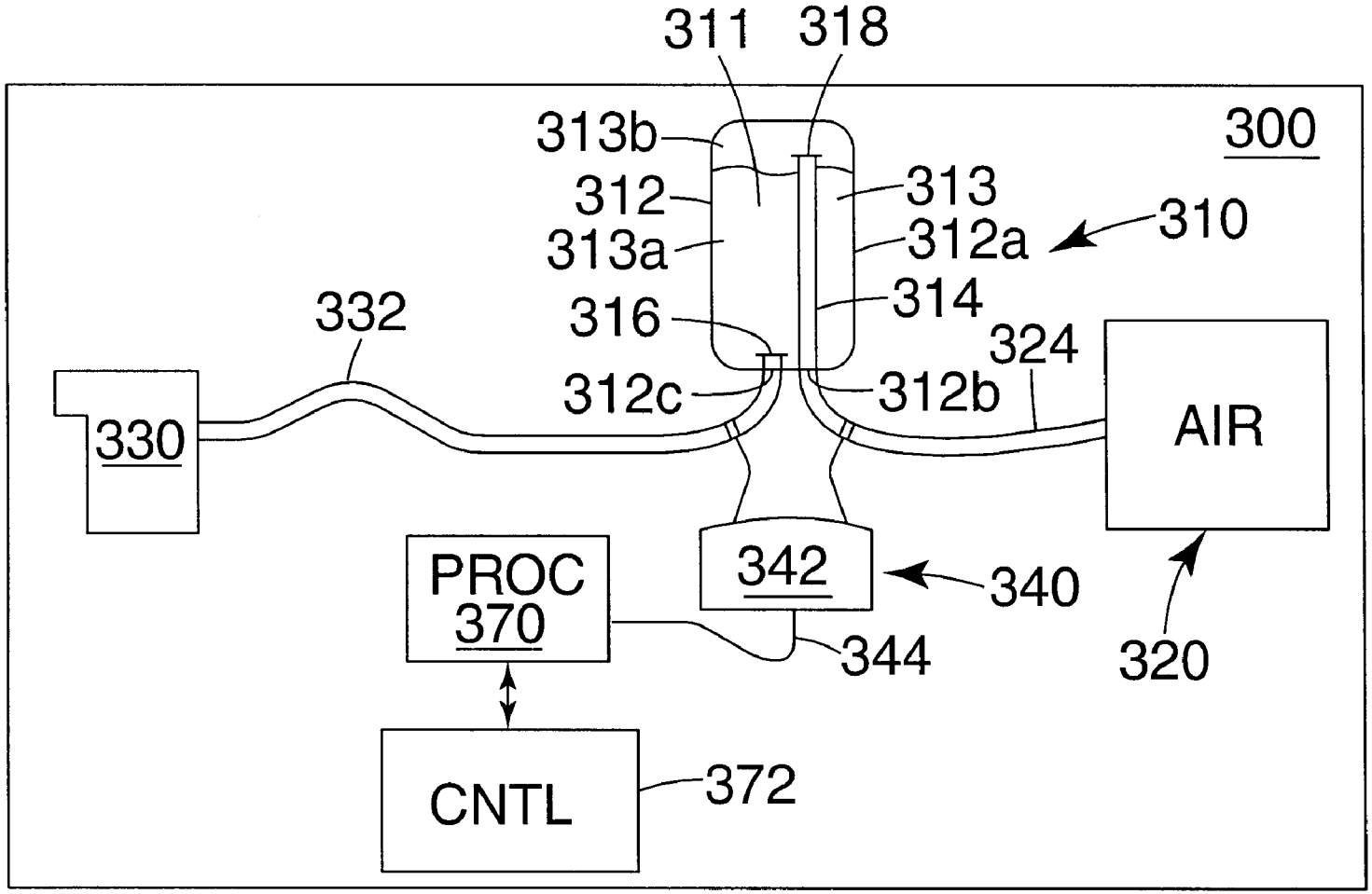
FIG. 4 is a schematic illustration of a portion of another embodiment of an inkjet printing system according to the present invention.

FIG. 4 illustrates another embodiment of a portion of an inkjet printing system 300. Inkjet printing system 300 includes an ink container 310, a pressurized source 320, a printhead 330, and a pressure sensor 340. Configuration and operation of pressurized source 320 and printhead 330 are similar to that previously described in connection with inkjet printing systems 100 and 200. Inkjet printing system 300 also includes a processing circuit 370 and a control circuit 272 similar to that described in connection with inkjet printing systems 100 and 200.

Ink container 310 communicates with pressurized source 320 and printhead 330 via a pressure supply line 324 and an ink supply line 332, respectively, and includes a housing 312 having walls 312*a* which define an interior chamber 313 adapted to directly contain liquid ink 311 therein. Thus, housing 312 includes an air passage 312*b* and an ink passage 312*c* defined therein. When liquid ink 311 is disposed within housing 312, an occupied portion 313*a* and an unoccupied portion 313*b* of interior chamber 313 are defined. Unoccupied portion 313*b* includes a portion of interior chamber 313 devoid of liquid ink 311. While housing 312 is illustrated as being generally rectangular in shape, it is within the scope of the present invention for housing 312 to be of any size, shape, and/or volume. As such, housing 312 is configured so as to fit the available space. Thus, size and shape of housing 312 can be configured to maximize a volume of liquid ink 311 contained within ink container 310.

In one embodiment, an air tube or snorkel 314 is disposed within housing 312 such that one end of air tube 314 communicates with air passage 312*b* and another end of air tube 314 communicates with unoccupied portion 313*b* of interior chamber 313. Thus, backpressure within interior chamber 313 is regulated through air tube 314. In addition, an air flow restrictor 316 communicates with ink passage 312*c* to restrict air flow and permit ink flow through ink passage 312*c*, and an ink flow restrictor 318 communicates with air passage 312*b* to restrict ink flow and permit air flow through air tube 314 and air passage 312*b*.

In one embodiment, air flow restrictor 316 is a filter screen material having an air flow restriction pressure, referred to as a bubble pressure, below which air is prevented from passing therethrough. As such, air at pressures less than the bubble pressure is restricted from passing through ink passage 312*c*. Thus, air flow restrictor 316 prevents air from entering ink supply line 332 and potentially damaging printhead 330. Liquid ink 311, however, freely passes through air flow restrictor 316 and, therefore, ink passage 312*c*, at pressures less than the bubble pressure. Thus, liquid ink 311 is supplied to printhead 330 through ink supply line 332. In one illustrative embodiment, the bubble pressure is approximately 45 inches of water. Bubble pressure is varied by varying mesh size of the filter screen material, as is well known to those skilled in the art.

In one embodiment, ink flow restrictor 318 is provided at an end of air tube 314 communicating with unoccupied portion 313*b* of interior chamber 313. In addition, ink flow restrictor 318 is a hydrophobic material, namely a material which lacks an affinity for water or other liquids. An example of such material is GORE-TEX®, manufactured by W. L. Gore and Associates. Thus, air freely passes through ink flow restrictor 318. Liquid ink 311, however, does not pass through ink flow restrictor 318. Thus, ink flow restrictor 318 prevents liquid ink 311 from contaminating pressure supply line 324 and/or pressurized source 320.

In use, pressurized air is released into interior chamber 313 through pressure supply line 324, air passage 312*b*, air tube 314, and ink flow restrictor 318. Thus, as pressurized air is released into interior chamber 313, and more specifically, unoccupied portion 313*b*, pressure within interior chamber 313 increases. Due to the increased pressure, a quantity of liquid ink 311 is driven through air flow restrictor 316 and, therefore, ink passage 312*c*. As such, liquid ink 311 flows consistently to printhead 330 through ink supply line 332 to printhead 330 thereby eliminating any need to reduce printing speed as liquid ink 311 is consumed. Pressure within interior chamber 313, however, is not increased above the air flow restriction pressure of air flow restrictor 316. Thus, air is prevented from passing through ink passage 312*c* and entering ink supply line 332.

In one embodiment, pressure sensor 340 includes a differential pressure sensor 342 communicating with air passage 312*b* and ink passage 312*c*. As such, a relative pressure differential between air passage 312*b* and ink passage 312*c* is sensed, wherein the relative pressure differential corresponds to an amount of liquid ink 311 disposed within ink container 310. Accordingly, the relative pressure differential is measured to monitor an ink level within ink container 310 and determine when ink container 310 is out of liquid ink 311.

Because liquid ink 311 flows freely and consistently through air flow restrictor 316, pressure within ink passage 312*c* does not change significantly until ink container 310 is nearly empty. As a level of liquid ink 311 diminishes, however, air contacts air flow restrictor 316. Since air cannot pass through air flow restrictor 316 (unless it exceeds the bubble pressure of air flow restrictor 316), pressure within ink passage 312*c* begins to increase as outflow of liquid ink 311 diminishes. The pressure differential, therefore, also begins to increase. As such, a signal corresponding to the pressure differential, as measured by differential pressure sensor 342, is generated and monitored to determine when ink container 310 is out of ink. Differential pressure sensor 342 also enables a "gas gauge" function for ink container 310 by providing continuous feedback of an amount of liquid ink 311 remaining within ink container 310. As such, full-speed printing is possible until liquid ink 311 is substantially depleted. It is, however, within the scope of the present invention for differential pressure sensor 342 to be replaced with absolute or gauge pressure sensors (with or without a pressure regulator) or pressure switches as described in connection with inkjet printing system 200.

Since housing 312 directly contains liquid ink 311 therein, substantially all of liquid ink 311 contained within ink container 310 is available for printing. In addition, an amount of ink, if any at all, stranded within ink container 310 is independent of a size and volume of housing 312. Thus, an amount of ink stranded within ink container 310 is minimized. Furthermore, since housing 20 directly contains liquid ink 311 therein, configuration of ink container 310 need only consider size, shape, volume, and orientation of housing 312 itself. Thus, size, shape, and volume of ink container 310 are independent of functional design. Ink container 310, therefore, minimizes an amount of stranded ink therein, eliminates the potential for drawing air into a printhead, and provides greater flexibility for container configurations. By minimizing an amount of stranded ink therein, ink container 310 also reduces environmental concerns and improves recyclability.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printing system, comprising:

a printhead;

an ink container communicating with and supplying liquid ink to the printhead, the printhead adapted to eject drops of the liquid ink during printing; and a leak indicator communicating with and indicating an ink container leak based on a pressure of liquid ink supplied to the printhead and a volume of liquid ink supplied to the printhead.

2. The printing system of claim 1, wherein the leak indicator indicates the ink container leak when the pressure of liquid ink supplied to the printhead is less than a predetermined value and the volume of liquid ink supplied to the printhead is greater than a predetermined value.

3. The printing system of claim 1, wherein the volume of liquid ink supplied to the printhead is derived from a count of a number of drops of the liquid ink ejected from the printhead.

4. The printing system of claim 1, further comprising:

a pressurized source of gas communicating with and supplying pressurized gas to the ink container, the pressurized gas adapted to pressurize the ink container and expel liquid ink therefrom during printing, wherein the pressure of liquid ink supplied to the printhead is based on a differential pressure of liquid ink supplied to the printhead and pressurized gas supplied to the ink container.

5. A printing system, comprising:

an ink container adapted to hold a supply of liquid ink therein;

a first flow path communicating with the ink container and the supply of liquid ink;

a printhead communicating with the first flow path, the printhead adapted to eject drops of the liquid ink during printing;

a pressure sensor communicating with the first flow path and measuring a pressure of liquid ink disposed therein;

a volume detector communicating with the first flow path and detecting a volume of liquid ink delivered therethrough; and a leak indicator communicating with the pressure sensor and the volume detector, the leak indicator indicating an ink container leak based on the pressure of liquid ink disposed in the first flow path and the volume of liquid ink delivered through the first flow path.

6. The printing system of claim 5, wherein the leak indicator indicates the ink container leak when the pressure of liquid ink disposed in the first flow path is less than a predetermined value and the volume of liquid ink delivered through the first flow path is greater than a predetermined value.

7. The printing system of claim 5, wherein the volume detector includes a drop counter communicating with the printhead, the drop counter adapted to count a number of drops of the liquid ink ejected from the printhead.

8. The printing system of claim 5, further comprising:

a second flow path communicating with the ink container; and a pressurized source of gas communicating with the second flow path, the pressurized source of gas adapted to pressurize the ink container and expel liquid ink therefrom, wherein the pressure sensor further communicates with the second flow path and measures a pressure of gas disposed therein, and wherein the leak indicator indicates the ink container leak based on a differential pressure of liquid ink disposed in the first flow path and gas disposed in the second flow path, and the volume of liquid ink delivered through the first flow path.

9. The printing system of claim 8, wherein the ink container includes a housing defining an interior chamber adapted to hold the supply of liquid ink therein, wherein the supply of liquid ink defines an occupied portion and an unoccupied portion of the interior chamber, and wherein the first flow path communicates with the occupied portion of the interior chamber and the second flow path communicates with the unoccupied portion of the interior chamber.

10. The printing system of claim 9, wherein the ink container further includes a collapsible ink reservoir disposed within the interior chamber of the housing, wherein the collapsible ink reservoir is adapted to hold the supply of liquid ink therein, and wherein the first flow path communicates with the collapsible ink reservoir and the second flow path communicates with the interior chamber of housing.

11. A method of detecting an ink container leak of an ink container adapted to hold a supply of liquid ink therein, the method comprising the steps of:

pressurizing the ink container to expel liquid ink therefrom;

measuring a pressure of liquid ink expelled from the ink container;

measuring a volume of liquid ink expelled from the ink container; and indicating the ink container leak based on the pressure of liquid ink expelled from the ink container and the volume of liquid ink expelled from the ink container.

12. The method of claim 11, wherein the step of indicating the ink container leak includes indicating the ink container leak when the pressure of liquid ink expelled from the ink container is less than a predetermined value and the volume of liquid ink expelled from the ink container is greater than a predetermined value.

13. The method of claim 11, wherein the step of measuring the pressure of liquid ink expelled from the ink container includes measuring a pressure differential between a pressure pressurizing the ink container and the pressure of liquid ink expelled from the ink container, and wherein the step of indicating the ink container leak includes indicating the ink container leak when the pressure differential is less than a predetermined value and the volume of liquid ink expelled from the ink container is greater than a predetermined value.

14. The method of claim 11, wherein the ink container is adapted to supply the liquid ink to a printhead, and wherein the step of measuring the volume of liquid ink expelled from the ink container includes counting ink drops ejected from the printhead during printing.

15. The method of claim 11, further comprising the step of:

discontinuing the step of pressurizing the ink container to expel liquid ink therefrom when the ink container leak is indicated.

16. The method of claim 11, wherein the ink container includes a collapsible reservoir disposed therein, wherein the collapsible reservoir is adapted to hold the supply of the liquid ink therein, and wherein the step of pressurizing the ink container to expel liquid ink therefrom includes applying pressure to the collapsible reservoir to expel liquid ink from the collapsible reservoir.

17. A printing system, comprising:

a housing having walls defining an interior chamber adapted to hold a supply of liquid ink therein, the supply of liquid ink defining an occupied portion and an unoccupied portion of the interior chamber;

a first flow path communicating with the occupied portion of the interior chamber of the housing and communicating externally of the housing, the first flow path adapted to deliver liquid ink therethrough;

a second flow path communicating with the unoccupied portion of the interior chamber of the housing and communicating externally of the housing, the second flow path adapted to deliver pressurized gas therethrough to the unoccupied portion of the interior chamber of the housing; and a pressure sensor communicating with the first flow path and adapted to measure a pressure of liquid ink delivered therethrough, and wherein the pressure sensor further communicates with the second flow path and is adapted to measure a pressure of pressurized gas delivered therethrough.

18. A printing system, comprising:

a housing having walls defining an interior chamber adapted to hold a supply of liquid ink therein, the supply of liquid ink defining an occupied portion and an unoccupied portion of the interior chamber;

a first flow path communicating with the occupied portion of the interior chamber of the housing and communicating externally of the housing, the first flow path adapted to deliver liquid ink therethrough;

a second flow path communicating with the unoccupied portion of the interior chamber of the housing and communicating externally of the housing, the second flow path adapted to deliver pressurized gas therethrough to the unoccupied portion of the interior chamber of the housing; and a pressure sensor communicating with the first flow path and adapted to measure a pressure of liquid ink delivered therethrough;

a volume detector communicating with the first flow path and detecting a volume of liquid ink delivered therethrough; and a leak indicator communicating with the pressure sensor and the volume detector, the leak indicator indicating an ink container leak based on the pressure of liquid ink delivered through the first flow path and the volume of liquid ink delivered through the first flow path.

19. The printing system of claim 18, wherein the leak indicator indicates the ink container leak when the pressure of liquid ink delivered through the first flow path is less than a predetermined value and the volume of liquid ink delivered through the first flow path is greater than a predetermined value.

20. A printing system, comprising:

a housing defining an interior chamber;

a collapsible reservoir disposed within the interior chamber of the housing, the collapsible reservoir adapted to hold a supply of liquid ink therein;

a first flow path communicating with the collapsible reservoir and communicating externally of the housing, the first flow path adapted to deliver liquid ink therethrough;

a second flow path communicating with the interior chamber of the housing and communicating externally of the housing, the second flow path adapted to receive pressurized gas therethrough; and a pressure sensor communicating with the first flow path and adapted to measure a pressure of liquid ink delivered therethrough, and wherein the pressure sensor further communicates with the second flow path and is adapted to measure a pressure of pressurized gas received therethrough.

21. A printing system, comprising:

a housing defining an interior chamber;

a collapsible reservoir disposed within the interior chamber of the housing, the collapsible reservoir adapted to hold a supply of liquid ink therein;

a first flow path communicating with the collapsible reservoir and communicating externally of the housing, the first flow path adapted to deliver liquid ink therethrough;

a second flow path communicating with the interior chamber of the housing and communicating externally of the housing, the second flow path adapted to receive pressurized gas therethrough; and a pressure sensor communicating with the first flow path and adapted to measure a pressure of liquid ink delivered therethrough a volume detector communicating with the first flow path and detecting a volume of liquid ink delivered therethrough; and a leak indicator communicating with the pressure sensor and the volume detector, the leak indicator indicating an ink container leak based on the pressure of liquid ink delivered through the first flow path and the volume of liquid ink delivered through the first flow path.

22. The printing system of claim 21, wherein the leak indicator indicates the ink container leak when the pressure of liquid ink delivered through the first flow path is less than a predetermined value and the volume of liquid ink delivered through the first flow path is greater than a predetermined value.

* * * * *